US005266078A

United States Patent [19]

Welkener et al.

[11] Patent Number: 5,266,078

[45] Date of Patent: Nov. 30, 1993

[54] ENHANCEMENT OF FLUORESCENT WHITENING AGENTS: WATER-SOLUBLE PHOSPHONATES AND CARBOXYLATES FOR COATING PAPER

[75] Inventors: Ulrich Welkener, Chester, England; Thord Hassler; Gunilla Hakansson, both of Helsingborg, Sweden

[73] Assignee: W. R. Grace & Co.-Conn., New York, N.Y.

[21] Appl. No.: 835,431

[22] PCT Filed: Jul. 3, 1991

[86] PCT No.: PCT/GB91/01081

§ 371 Date: Feb. 19, 1992

§ 102(e) Date: Feb. 19, 1992

[87] PCT Pub. No.: WO92/01115

PCT Pub. Date: Jan. 23, 1993

[30] Foreign Application Priority Data

Jul. 3, 1990 [GB] United Kingdom ..... 9014767

[51] Int. Cl.[5] ..... D06L 3/12; D21H 21/30; D21H 37/66; C11D 9/44

[52] U.S. Cl. ..... 8/648; 8/584; 8/594; 8/919; 252/8.6

[58] Field of Search ..... 8/584, 598, 599, 648, 8/594; 252/8.6

[56] References Cited

U.S. PATENT DOCUMENTS

| | | | |
|---|---|---|---|
| 4,263,431 | 4/1981 | Weber et al. | 252/301.22 |
| 4,304,569 | 12/1981 | Engelhardt et al. | 8/584 |
| 4,386,965 | 6/1983 | Fringeli et al. | 8/584 |
| 4,670,183 | 6/1987 | Louman et al. | 252/301.35 |
| 4,970,019 | 11/1990 | Crosby et al. | 252/186.27 |
| 4,978,470 | 12/1990 | Suzuki et al. | 252/174.12 |
| 5,035,825 | 7/1991 | Eckhardt et al. | 252/95 |
| 5,082,578 | 1/1992 | Langer et al. | 8/647 |

FOREIGN PATENT DOCUMENTS 1369202 10/1974 United Kingdom .

*Primary Examiner*—A. Lionel Clingman
*Attorney, Agent, or Firm*—James P. Barr

[57] ABSTRACT

A method of enhancing the whiteness of a cellulosic material is described which comprises incorporating therein, or applying thereto, a fluorescent whitening agent, a water soluble phosphonate having 1 to 5 phosphonate groups and/or a water soluble carboxylate having 2 to 5 carboxylate groups at a neutral or alkaline pH.

25 Claims, No Drawings

ENHANCEMENT OF FLUORESCENT WHITENING AGENTS: WATER-SOLUBLE PHOSPHONATES AND CARBOXYLATES FOR COATING PAPER

This invention relates to enhancing the whiteness of a cellulosic material, typically paper or cotton.

It is well known that paper and other cellulosic materials which are essentially white have a certain degree of yellowness. This results from a reduced blue remission. Accordingly, various ways have been found of reducing this deficiency, typically using a fluorescent whitening agent. Unfortunately, though, the use of such agents does not wholly eliminate the problem efficiently and some discolouration can still occur.

The present invention is directed to improving the efficiency of fluorescent whitening agents. It has surprisingly been found, according to the present invention, that if the fluorescent whitening agent is applied in combination with certain phosphonates and/or carboxylates an enhanced effect can be obtained.

According to the present invention there is provided a method of enhancing the whiteness of a cellulosic material which comprises incorporating therein, or applying thereto, a fluorescent whitening agent and a water soluble phosphonate having 1 to 5 phosphonate groups and/or a water soluble carboxylate having 2 to 5 carboxylate groups but no chain nitrogen atoms, at a neutral or alkaline pH.

The present invention is of general applicability and the specified additives can be used to enhance the effect of a wide range of fluorescent whitening agents. These are chemicals having the capability of increasing the apparent blue remission of a material in or on which they are applied by absorbing UV radiation and by re-emitting visible blue light. Conventional fluorescent whitening agents which can be used in the prevent invention are generally stilbene compounds, especially:

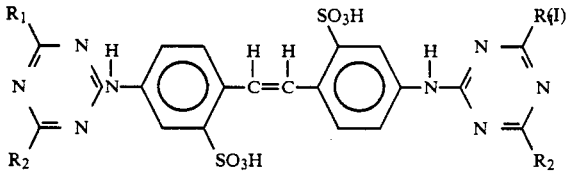

(I)

wherein $R_1$ can be

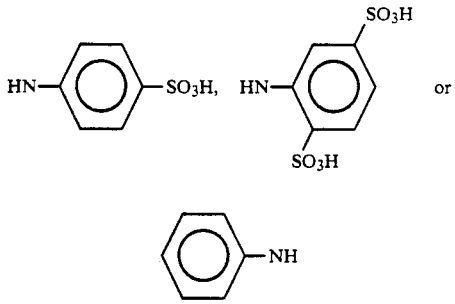

—and $R_2$ can be $N(CH_2—CH_3)_2$, $N(CH_2—CH_2—OH)_2$ or

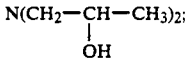

coumarin and carbostyril compounds such as

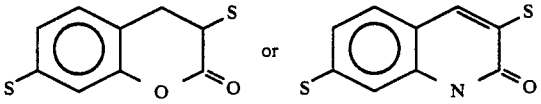

1,3-diphenyl-2-pyrazoline compounds such as

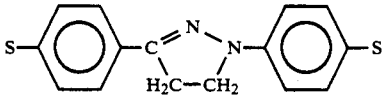

and naphthalimide compounds such as

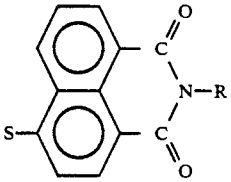

Other fluorescent whitening agents which can be used include those mentioned in "Fluorescent Whitening Agents", edited by R. Anliker and G. Muller, Georg Thieme, Stuttgart, 1975, Chapter III.

In general any water soluble phosphonate having 1 to 5 phosphonate groups can be used in the method of the present invention; substantially colourless phosphonates are preferred. A preferred phosphonate is diethylenetriamine-pentamethylene phosphonic acid (DTPMPA) (and its water soluble salts). Other preferred phosphonates are hydroxy alkylidene diphosphonic acids having the formula:

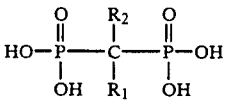

wherein $R_1$ is OH or $NH_2$ and $R_2$ is an alkyl group of 1 to 5 carbon atoms, and water soluble salts of said diphosphonic compounds. A particularly preferred phosphonate is 1-hydroxyethylidene-1,1-diphosphonic acid (HEDPA) (and its water soluble salts).

The carboxylates which can be used in the present invention are generally substantially colourless and preferably contain 2 or 3 carboxyl groups. They may also contain a hydroxyl group. They are preferably aliphatic and preferably also have carboxyl groups at opposite ends of the aliphatic chain. The aliphatic chain contains no chain nitrogen atom. Typical carboxylates are those having the formula:

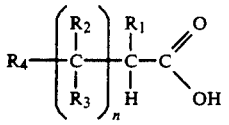

wherein $R_1$ is OH or H, $R_2$ and $R_3$ are each independently H, OH or COOH, and $R_4$ is H, OH, COOH, $CH_2OH$ or $CH_2COOH$, and n=0 to 6, which do not contain more than 5 carboxyl groups, and water soluble salts thereof.

Preferred carboxylates include sebacic acid and succinic acid. A particularly preferred compound is citric acid.

Typical water soluble salts include sodium, potassium and ammonium salts.

It will, of course, be appreciated that a mixture of phosphonates and/or carboxylates can be used, for example a phosphonic acid together with a water soluble salt of said acid or a phosphonate and a carboxylate. In this connection it is also possible to use a single compound, i.e. a di- or higher carboxylate containing at least one phosphonate group such as 2-phosphonobutane-1,2,4-tricarboxylic acid (PBSAM).

The fluorescent whitening agent is most conveniently added to an aqueous system such as a paper making furnish. As indicated this must have a neutral or alkaline pH for the combination of fluorescent whitening agent and additive to be fully effective. The pH may be as high as, say, 12 but, in general it will be greater than 7 but not greater than 9.

The fluorescent whitening agent is typically used in an amount from 0.1 to 10 kg/tonne (dry solids) and preferably from 0.5 to 5 kg/tonne. The amount of phosphonate or carboxylate is typically from 0.01 to 5 kg/tonne (dry solids) and preferably from 0.05 to 2.5 kg/tonne.

The general weight ratio of fluorescent brightening agent to the additive is from 10:1 to 1:1, especially 10:1 to 4:1.

The present invention is particularly useful in the preparation of paper but it can also be applied to other cellulosic materials such as cotton.

While the fluorescent whitening agent and additive will normally be added separately it is also possible to add them together. Accordingly, the present invention also provides a composition suitable for addition to a cellulosic material which comprises a fluorescent whitening agent and a water-soluble phosphonate having 1 to 5 phosphonate groups and/or a water-soluble carboxylate having 2 to 5 carboxylate groups. The composition may also contain an alkalysing agent to prevent the fluorescent whitening agent from precipitating.

Alternatively the additive can be incorporated in a composition containing a fluorescent whitening agent to be used for coating the cellulosic material. Such compositions generally comprise a pigment such as kaolin, calcium carbonate, amorphous silicas and silicates, titanium dioxide, and a binder such as starch, casein, soy protein and styrene butadiene latex, as well as flow modifiers such as carboxymethylcellulose, dispersants such as polyacrylates, lubricants such as stearic acid salts, preservatives, antifoam agents and other additives. For this purpose the fluoresecent whitening agent is suitably used in an amount from 0.1 to 2 kg/tonne (dry solids), and preferably from 0.5 to 1 kg/tonne, of dry coating composition. The amount of phosphonate or carboxylate is typically from 0.01 to 2.5 kg/tonne (dry solids) and preferably from 0.05 to 1.25 kg/tonne. The weight ratio of fluorescent brightening agent to the additive is as specified above.

The following Examples further illustrate the present invention.

MATERIALS USED

Fully bleached hardwood kraft pulp, trade name: Skogcell Birch (Sweden)

NaCl, Analytical Grade

NaOH, Analytical Grade

Fluorescent Whitening Agent, trade name: Blankophor P (Bayer), a stilbene compound 1-hydroxyethylidene-1,1-diphosphonic acid (HEDPA)

Citric acid

N,N-di(hydroxyethyl)glycine sodium salt (DHEGNa)

2-Phosphonobutane-1,2,4-tricarboxylic acid (PBSAM)

Diethylenetriamine-pentamethylene phosphonic acid, sodium salt (DTPMPA Na)

Diethylene triamine-pentaacetic acid, sodium salt ($DTPANa_5$)

Succinic acid

Sebacic acid

HANDSHEET PREPARATION 12 g of Skogcell Birch pulp were dispersed in 2000 ml deionised water for 2 minutes using an Ultra Turrax high sheer mixer at 10,000 rpm. Subsequently 2000 ml of deionised water were added under continuous stirring using a laboratory stirrer. 1000 ml aliquots were taken from the dispersion. Each aliquot was used to prepare one handsheet for brightness measurement after the addition of the respective materials under continued stirring using a magnetic stirrer.

The order of addition was as follows:

1. Adjustment of ionic strength using 1870 ppm NaCl
2. Adjustment of pH to approximately 8 using a 0.1M NaOH solution
3. Addition of dilute solutions of HEDPA, citric acid, DHEG Na, PBSAM, DTPMPA, DTPA, succinic acid or sebacic acid (the pH of these solutions was also adjusted to approximately pH 8 using 1 and 0.1M NaOH solutions prior to addition)
4. Addition of dilute Blankophor P solution (the pH was adjusted to pH 9 using 1 and 0.1M NaOH solutions prior to addition)

The handsheets were then prepared according to TAPPI Standard Test Method T 218 om-83.

BRIGHTNESS MEASUREMENT

Brightness of the handsheets was measured on a Macbeth Colour Measurement System using Standard Illuminant D65. A white ceramic tile standard supplied with the instrument was used for calibrations.

EXAMPLE 1

The beneficial effect of adding HEDPA can be seen from Table I.

TABLE 1

| % Blankophor P Based on Dry Pulp | % HEDPA Based on Dy Pulp | Brightness Index |
|---|---|---|
| 0.4 | — | 97.9 |
| 0.4 | 0.1 | 99.5 |

TABLE 1-continued

| % Blankophor P Based on Dry Pulp | % HEDPA Based on Dy Pulp | Brightness Index |
|---|---|---|
| 0.8 | — | 100.4 |
| 0.8 | 0.1 | 102.1 |
| — | — | 90.0 |
| — | 0.1 | 90.0 |

It can be also seen that HEDPA by itself has not effect on the initial pulp brightness.

EXAMPLE 2

Results of adding citric acid to improve the effect of fluorescent whitening agents are given in Table II.

TABLE 2

| % Blankophor P Based on Dry Pulp | % Citric Acid Based on Dry Pulp | Brightness Index |
|---|---|---|
| 0.4 | — | 97.9 |
| 0.4 | 0.1 | 99.8 |
| 0.8 | — | 100.4 |
| 0.8 | 0.1 | 101.6 |
| — | — | 90.0 |
| — | 0.1 | 89.5 |

It can also be seen that there is no positive effect of adding citric acid by itself, on the initial pulp brightness.

COOPERATIVE EXAMPLE 1

Results of adding DHEG Na to improve the effect of fluorescent whitening agents are shown in Table 3.

TABLE 3

| % Blankophor P Based on Dry Pulp | DHEG Na Based on Dry Pulp | Brightness Index |
|---|---|---|
| 0.4 | — | 97.9 |
| 0.4 | 0.1 | 98.4 |
| 0.8 | — | 100.4 |
| 0.8 | 0.1 | 100.0 |

This shows that there is no enhancement of the fluorescent whitening agent by DHEG Na.

EXAMPLE 3

The results of adding PBSAM are shown in Table 4.

TABLE 4

| % Blankophor P Based on Dry Pulp | % PBSAM Based on Dry Pulp | Brightness Index |
|---|---|---|
| 0.4 | — | 97.9 |
| 0.4 | 0.1 | 98.5 |
| 0.8 | — | 100.4 |
| 0.8 | 0.1 | 100.9 |
| — | — | 90.0 |
| — | 0.1 | 89.4 |

It can be seen that the additive by itself shows no positive effect, in contrast to the situation when the brightener is present.

EXAMPLE 4

The results of adding DTPMPA are shown in Table 5

TABLE 5

| % Blankophor P Based on Dry Pulp | % DTPMPA Based on Dry Pulp | Brightness Index |
|---|---|---|
| 0.4 | — | 97.9 |
| 0.4 | 0.1 | 98.9 |

TABLE 5-continued

| % Blankophor P Based on Dry Pulp | % DTPMPA Based on Dry Pulp | Brightness Index |
|---|---|---|
| 0.8 | — | 100.4 |
| 0.8 | 0.1 | 101.4 |
| — | — | 90.0 |
| — | 0.1 | 89.3 |

It can be seen that the additive by itself shows no positive effect, in contrast to the situation when the brightener is present.

EXAMPLE 5

The results of adding a 1:1.25 HEDPA/Citric acid mixture are shown in Table 6.

TABLE 6

| % Blankophor P Based on Dry Pulp | % HEDPA/Citric Acid (1:1.25) Based on Dry Pulp | Brightness Index |
|---|---|---|
| 0.4 | — | 97.9 |
| 0.4 | 0.1 | 99.1 |
| 0.8 | — | 100.4 |
| 0.8 | 0.1 | 101.4 |
| — | — | 90.4 |
| — | 0.1 | 89.5 |

It can be seen that the additive mixture by itself shows no positive effect, in contrast to the situation when the brightener is present.

COMPARATIVE EXAMPLE 2

The results of adding diethylenetriaminepenta-acetic acid (DTPA) are shown in Table 7.

TABLE 7

| % Blankophor P Based on Dry Pulp | % DTPA $Na_5$ Based on Dry Pulp | Brightness Index |
|---|---|---|
| 0.4 | — | 97.9 |
| 0.4 | 0.1 | 98.3 |
| 0.8 | — | 100.4 |
| 0.8 | 0.1 | 99.8 |

This shows that there is no enhancement of the fluorescent whitening agent by DTPA $Na_5$.

EXAMPLE 6

The results of adding succinic acid are shown in Table 8

TABLE 8

| % Blankophor P Based on Dry Pulp | % Succinic Acid Based on Dry Pulp | Brightness Index |
|---|---|---|
| 0.4 | — | 97.9 |
| 0.4 | 0.1 | 98.8 |
| 0.8 | — | 100.4 |
| 0.8 | 0.1 | 100.9 |
| — | — | 90.0 |
| — | 0.1 | 89.7 |

This shows how the additive enhances the brightening effect of the brightener. In contrast there is no enhancement when the additive is used alone.

EXAMPLE 7

The results of adding sebacic acid are shown in Table 9

TABLE 9

| % Blankophor P Based on Dry Pulp | % Sebacic Acid Based on Dry Pulp | Brightness Index |
|---|---|---|
| 0.4 | — | 97.9 |
| 0.4 | 0.1 | 98.8 |
| 0.8 | — | 100.4 |
| 0.8 | 0.1 | 101.5 |
| — | — | 90.0 |
| — | 0.1 | 90.7 |

This shows how the additive enhances the brightening effect of the brightener. In contrast there is no enhancement when the additive is used alone.

We claim:

1. A method of enhancing the whiteness of a cellulosic paper material which comprises applying thereto a coating composition which comprises a fluorescent whitening agent and a water soluble phosphonate wherein the phosphonate is diethylene triamine-pentamethyline phosphonate or a phosphonate of a hydroxy alkylidene diphosphonic acid having the formula:

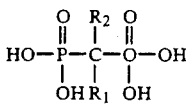

wherein $R_1$ is OH or $NH_2$ and $R_2$ is an alkyl group of 1 to 5 carbon atoms and/or a water soluble carboxylate wherein the carboxylate has the formula:

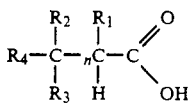

wherein $R_1$ is OH or H, $R_2$and $R_3$ are each independently H, OH or COOH, and $R_4$ is H, OH, COOH, $CH_2OH$ or $CH_2COOH$ and n=0 to 6, and wherein the cellulosic material has a neutral or alkaline pH.

2. A method according to claim 1 in which the phosphonate is 1-hydroxyethylidene-1,1-diphosphonic acid.

3. A method according to claim 1 in which the carboxylate is substantially colourless and contains 2 or 3 carboxyl groups.

4. A method according to claim 1 in which the carboxylate is aliphatic and possesses carboxyl groups at opposite ends of the aliphatic chain.

5. A method according to claim 1 in which the carboxylate is a sebacate, succinate or citrate.

6. A method according to claim 1 in which the phosphonate is a 2-phosphonobutane-1,2,4-tricarboxylate.

7. A method according to claim 1 in which the phosphonate and/or carboxylate is in the form of a sodium salt.

8. A method according to claim 1 in which the fluorescent whitening agent and phosphonate or carboxylate are added to a paper making furnish.

9. A method according to claim 8 in which the fluorescent whitening agent is used in an amount from 0.5 to 5 kg/tonne (dry basis) and the phosphonate or carboxylate is used in an amount from 0.05 to 2.5 kg/tonne (dry basis).

10. A method according to claim 1 in which the weight ratio of fluorescent brightening agent to the phosphonate or carboxylate is from 10:1 to 4:1.

11. A method according to claim 1 in which the fluorescent whitening agent is a stilbene compound.

12. A composition suitable for incorporating in, or adding to, a cellulosic paper material which comprises a fluorescent whitening agent and a water soluble phosphonate wherein the phosphonate is diethylene triamine-pentamethylene phosphonate or a phosphonate of a hydroxy alkylidene diphosphonic acid having the formula:

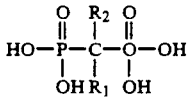

wherein $R_1$ is OH or $NH_2$ and $R_2$ is an alkyl group of 1 to 5 carbon atoms, optionally containing a water soluble carboxylate wherein the carboxylate has the formula:

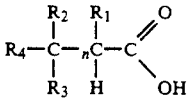

wherein $R_1$ is OH or H, $R_2$ and $R_3$ are each independently H, OH or COOH, and $R_4$ is H, OH, COOH, $CH_2OH$ or $CH_2COOH$ and n=0 to 6.

13. A composition according to claim 16 in which the phosphonate is 1-hydroxyethylidene-1,1-diphosphonic acid.

14. A composition according to claim 12 in which the carboxylate is substantially colourless and contains 2 or 3 carboxyl groups.

15. A composition according to claim 12 in which the carboxylate is aliphatic and possesses carboxyl groups at opposite ends of the aliphatic chain.

16. A composition according to claim 12 in which the carboxylate is a sebacate, succinate or citrate.

17. A composition according to claim 12 in which the phosphonate is a 2-phosphonobutane-1,2,4-tricarboxylate.

18. A composition according to claim 12 in which the phosphonate and/or carboxylate is in the form of a sodium salt.

19. A composition according to claim 12 in which the weight ratio of fluorescent brightening agent to the phosphonate or carboxylate is from 10:1 to 4:1.

20. A composition according to claim 12 in which the fluorescent whitening agent is a stilbene compound.

21. A composition according to claim 12 which also contains an alkalising agent.

22. A composition according to claim 12 which is in a form suitable for addition to a paper making furnish.

23. A composition according to claim 12 which is in the form of a coating composition.

24. A composition according to claim 23 which also comprises a pigment and a binder.

25. A composition according to claim 23 which contains from 0.1 to 2 kg/tonne of fluorescent whitening agent, and 0.01 to 2.5 kg/tonne of phosphonate or carboxylate, dry basis.

* * * * *